US009131581B1

(12) United States Patent
Hsia et al.

(10) Patent No.: US 9,131,581 B1
(45) Date of Patent: Sep. 8, 2015

(54) SOLID-STATE LIGHTING CONTROL WITH DIMMABILITY AND COLOR TEMPERATURE TUNABILITY

(71) Applicant: Lightel Technologies, Inc., Renton, WA (US)

(72) Inventors: Chungho Hsia, Bellevue, WA (US); Pai-Sheng Shen, Bellevue, WA (US)

(73) Assignee: Lightel Technologies, Inc., Renton, WA (US)

( * ) Notice: Subject to any disclaimer, the term of this patent is extended or adjusted under 35 U.S.C. 154(b) by 53 days.

(21) Appl. No.: 14/214,450

(22) Filed: Mar. 14, 2014

(51) Int. Cl.
*H05B 37/02* (2006.01)
*H05B 33/08* (2006.01)

(52) U.S. Cl.
CPC ..... *H05B 33/086* (2013.01); *H05B 33/0815* (2013.01); *H05B 33/0845* (2013.01); *H05B 33/0896* (2013.01)

(58) Field of Classification Search
CPC ..... H05B 33/0839; H05B 33/0863
USPC ..... 315/294, 210, 297, 313
See application file for complete search history.

(56) References Cited

U.S. PATENT DOCUMENTS

2015/0115809 A1* 4/2015 Siessegger ..... 315/185 R

* cited by examiner

*Primary Examiner* — Daniel D Chang
(74) *Attorney, Agent, or Firm* — Han IP Corporation

(57) ABSTRACT

A dimming and CCT tuning system comprises a controller and multiple LED-based lighting devices. Each lighting device comprises a control circuit, at least two LED driving circuits, and at least two types of LED-based light sources. When the controller receives the dimming and CCT tuning signals from its inputs, it generates a modulated dimming and CCT tuning signal portion in the AC voltage delivered to the multiple lighting devices. Afterwards, a regular AC power is delivered. In receiving, each lighting device demodulates such signal portion and generates at least two control signals to the at least two LED driving circuits which then individually power the at least two types of LED-based light sources to emit desired light levels and CCTs. The system eliminates extra wires required in 0-10 V dimming control and maintains an undistorted AC waveform in most of operating time, not like a TRIAC dimming.

18 Claims, 5 Drawing Sheets

SOLID-STATE LIGHTING CONTROL WITH DIMMABILITY AND COLOR TEMPERATURE TUNABILITY

TECHNICAL FIELD

The present disclosure relates to a lighting control of light-emitting diode (LED)-based lighting devices, and more particularly to a system and a method for LED-based lighting devices that require dimmability and correlated color temperature (CCT) tunability.

BACKGROUND

Solid-state lighting from semiconductor LED light sources has received much attention in general lighting applications today. Because of its potential for more energy savings, better environmental protection (with no hazardous materials used), higher efficiency, smaller size, and longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED-based lighting for their illumination applications. In this trend, more energy saving with a dimming control, more efficient CCT tunability, more environmental protection, and more aesthetic perception in lighting quality have become especially important and need to be well addressed.

The relationship between actual dimming and perceived dimming is not linear but logarithmic by nature because the human eye responds to low light levels by enlarging the pupil, allowing more light to enter the eye. This response results in a difference between measured and perceived light levels. For example, a lamp that is dimmed to 10% of its maximum measured light output is perceived as being dimmed to only 32%. Similarly, a lamp dimmed to 25% is perceived to be at 50%. Taking advantage of such differences, the use of a dimmer on LED-based lamps can save even more energy than actual dimming itself. Besides, reduced electrical consumption can further prolong life expectancy of the LED-based lamps and reduce maintenance or replacement costs.

A conventional wall-mount dimmer uses a leading-edge phase angle, trailing-edge phase angle, or phase cut to control a power delivering to a lighting device. Whereas such a dimmer seems to provide energy efficiency and is driving consumers to replace standard incandescent lamps with LED-based retrofit lamps, consumers often find that the performance they expect is not being achieved, at least when the solid-state lighting (SSL) products are used with existing TRIAC or phase-cut dimmers. Dimmer compatibility with LED-based lighting devices is a main issue. Basically, the wall-mount TRIAC dimmers are not so designed for LED loads that the existing residential wiring infrastructure can limit their capabilities for modern lighting controls. Furthermore, there are no industry standards that specifically guide LED dimming performance, and as such, a number of undesirable results may occur when one uses a dimmable LED-based lamp with an incandescent dimmer, such as reduced dimming range, flickering or strobing of the lamp, and inconsistent performance based on the number and classification of lamps being controlled by one incandescent dimmer. Moreover, a recent IEEE report raised a health concern due to invisible flicker at frequencies below 165 Hz including seizures, headaches, migraines, impaired ocular motor control, and impaired visual performance, etc.

Most of the existing residential and commercial electrical dimming infrastructures are single channel wall dimmers, which are crucial to serve the market with high quality solutions and to solve the various challenges to come. Furthermore, power factor of an electrical appliance refers simply to the degree to which the voltage potential and electric current draw required by the electrical appliance are in-phase for each half-cycle of the sinusoidal AC waveform. In fact, the current waveform should be in phase with AC voltage waveform to have a maximum power delivered to the load resulting in a unity power factor as in a purely resistive circuit. Conventional dimmers themselves have a major effect on power factor for all kinds of loads—capacitive, inductive, non-linear, and even linear and resistive, because such dimmers typically cut voltage phase over the current peak as required by the load, causing imbalance and harmonic distortion on the AC line. Poor power factor is rarely noticed by residential end-users because their utility companies usually pay the price by spending money on hardware and additional power to correct for this imbalance throughout their distribution systems. However, commercial users may either pay additional surcharges for low power factor or improve it at their own cost. For example, if their loads are highly inductive, they may have to install capacitor switch banks to compensate for this power loss.

A conventional driver employed to drive an LED-based lamp basically uses a switch-mode power supply (SMPS) and is considered to be nonlinear with reactive loads, which requires power factor correction (PFC) to reduce non-sinusoidal current distortion and excess energy at harmonics of the line frequency of the voltage. The EU standard EN61000-3-2 regulates harmonic contents and basic PFC criteria for all such switch-mode power supplies. Passive PFC in drivers/power supplies adopted in LED-based lamps usually involve adding capacitors, resistors and steering diodes in a valley-fill circuit. However, the power factor improvement using such a passive PFC circuit is limited. Active PFC involves redistributing the current over the voltage half-cycle waveform. The key is how to improve load regulation without adversely affecting the power factor or to make the load look like a linear resistor. Today, a conventional LED driver employing active PFC typically uses an energy transfer element that includes a flyback transformer to store energy which then directly provides LED current to an LED load. Although simple and low-cost, such a single-stage driver configuration provides so limited functionalities that can barely meet market demands. For example, market needs an external LED driver which can flexibly control one to several LED-based lighting devices in a luminaire. When part of lighting devices are removed from the luminaire for maintenance or replacement, an overall rated current can flow into the remaining LED-based lighting devices, resulting in excessive driving current for LED-based light sources. Market also needs an LED driver which can provide two or three sets of electric current to two or three types of LED-based light sources in order to control CCT of an LED lighting device that comprises such two or three types of LED-based light sources. The conventional LED driver can only provide single channel current control and thus fails to meet these market requirements.

Used as an early fluorescent dimming system and still used today, 0-10 V dimming has been employed to become one of reliable LED dimming control protocols although it is one of the earliest and simplest electronic lighting control signaling systems. A 0-10 V dimmer does not cut AC voltage for introducing phases and thus keep the AC voltage waveform intact. However, to control a dimming level of a lighting device using such a 0-10 V dimmer, one needs to have two extra low-voltage wires separately connected to the lighting device to be dimmed in addition to the power lines from the AC mains. This is so called 4-wire low voltage 0-10 VDC dimming. The low voltage control wires are polarity sensitive, and so accuracy is critical in wiring. This increases the wiring difficulty and installation cost, especially for the existing residential and commercial infrastructures that have two or three power wires in a wall-mount electrical box.

In today's lighting applications, CCT tuning is important. Although consumers demand a CCT tunable lamp that can tune from warm-white at 2,700 K, via sun-white and natural-white at 4,100 K, to cool-white at 6,200±300 K in general lighting to help improve the atmosphere in their working, exhibiting, or living areas, there have been very few such lighting products in luminaire markets. Manufacturers can generally make an LED-based lighting device using two kinds of phosphor coated white LEDs, one cool white and the other warm white, to mix light emissions with different ratios to come up with desired CCTs. However, the approach needs a proper LED driver to provide two sets of electric current with a proper ratio to the cool white and the warm while LEDs such as to emit a light emission with desired CCTs. A conventional driver apparently cannot meet such requirements.

SUMMARY

The present disclosure relates to a lighting control of LED-based lighting devices that adopt a command scheme to control multiple LED-based lighting devices that require dimmability and CCT tunability. As mentioned in the description of related art, the best solution to avoiding wiring difficulty associated with 4-wire low voltage 0-10 VDC dimming control is to incorporate dimming control signals into the power line in the dimming mode and to remove dimming control signals from the power line in the normal mode. In this case, AC voltage in the power line remains intact in most of operating time, thus providing an acceptable power factor. To control an LED-based lighting device with dimmability and CCT tunability, one needs to have a dimming and CCT tuning controller comprising power input terminals, a voltage sensing circuit, a dimming input, a CCT tuning input, a modulator, an AC current return controller, and a dimming and CCT signal generator that generates control signals to control the modulator and the AC current return controller. The dimming and CCT tuning controller can generate dimming and CCT tuning commands according to signals received from a dimming input and a CCT tuning input, which involves multiplexing dimming and CCT tuning signals and modulating the multiplexed dimming and CCT tuning signal portion in the AC voltage to deliver to the LED-based lighting device. In the LED-based lighting device, a demodulator needs to recover the dimming and CCT tuning signal portion and to generate pulse-width modulation (PWM) control signals to control at least two sets of drive current provided for two types of LED-based light sources in the lighting device to change dimming levels and to tune CCT of the lighting device.

Without introducing AC voltage waveform distortion that happens in an AC phase control dimming and affects the power quality, the dimming and the CCT tuning commands are sent in a dimming and CCT tuning mode but not resent in a normal mode unless there are signal changes. In the dimming and CCT tuning mode, a time-division multiplexing is used in the dimming and CCT tuning controller to multiplex the dimming and the CCT tuning signals with a command initiation signal in the first three cycles of the voltage in AC mains to form a complete command that includes the dimming and the CCT tuning signal portion and the command initiation signal. In the normal mode, however, the dimming and CCT tuning controller sends a regular AC voltage to the lighting device to maintain its dimming level and CCT.

The voltage sensing circuit is connected to the power input terminals which receive an AC power for sensing voltage peaks of the AC mains in the dimming and CCT tuning mode to provide synchronization information for the dimming and CCT tuning signals to be successfully modulated and delivered to the lighting device. The dimming and CCT tuning signal generator generates two sets of control signals, one in the dimming and CCT tuning mode and the other in the normal mode. Each set of the control signals comprises two control signals, controls signal 1 sent to the AC current return controller and controls signal 2 sent to the modulator. In the dimming and CCT tuning mode, the controls signal 1 is sent to disable the AC current return controller in the positive half cycle while the controls signal 2 is sent to turn the modulator on and off according to the dimming and CCT tuning signals. In this way, the dimming and the CCT tuning signals are modulated in the AC voltage to form a dimming and CCT tuning output power to deliver to the LED-based lighting device. After the three cycles in the dimming and CCT tuning mode, if users perform no dimming and CCT tuning adjustment, the dimming and CCT tuning controller enters the normal mode. In the normal mode, the controls signal 1 is sent to enable the AC current return controller in the positive half cycles while the controls signal 2 is sent to disable the modulator; no dimming and CCT tuning signals are modulated and sent, thus a regular AC power being delivered to the LED-based lighting device. As the time for performing a dimming and CCT tuning adjustment is within three cycles of the AC mains or 3/60 seconds, AC voltage distortion can be ignored in a long term perspective, thus maintaining a power factor which is only determined by the LED driver used to drive the LED-based light sources in the LED-based lighting device.

A dimming and CCT tuning lighting system comprises the foregoing dimming and CCT tuning controller and at least one lighting device. The at least one lighting device comprises a demodulator, a dimming and CCT tuning controllable driver comprising a power supply section and an LED driving section further comprising at least two LED driving circuits, a dimming and CCT tuning control circuit, and at least two types of LED-based light sources. The power supply section, connecting to the output terminals of the dimming and CCT tuning controller, receives and converts a regular AC power or the dimming and CCT tuning output power into a DC power supplying the dimming and CCT tuning control circuit and the at least two LED driving circuits which then drive at least two types of LED-based light sources to emit light. The demodulator receives the dimming and CCT tuning output power and extracts a dimming and CCT tuning signal portion in the dimming and CCT tuning output power. Based on the recovered dimming and CCT tuning signal portion, the dimming and CCT tuning control circuit generates PWM control signals to send to the at least two LED driving circuits to change at least two sets of time-averaged driving current to drive the at least two types of LED-based light sources to emit a resultant light with a desired dimming level and CCT. In the normal mode, the demodulator receives the regular AC power, and the dimming and CCT tuning control circuit sends PWM control signals to LED driving circuits simply to maintain the original time-averaged driving current to drive the LED-based light sources with an unchanged the dimming level and the CCT.

The present disclosure provides a method in the dimming and CCT tuning lighting system that comprises the dimming and CCT tuning controller used for multiplexing and modulating dimming and CCT tuning signals in the voltage of the AC mains in the dimming and CCT tuning mode. A modulated dimming and CCT tuning output power is delivered to multiple LED-based lighting devices to change their dimming levels and CCTs. The method comprises: (1) the dimming and CCT tuning controller determines if receiving a user signal to perform a dimming and CCT tuning adjustment; (2) if the dimming and CCT tuning controller is not instructed to perform the dimming and CCT tuning adjustment, the dimming and CCT tuning controller executes a normal process in a normal mode, in which the AC power is delivered to the multiple lighting devices to maintain their luminance and CCTs; (3) if the dimming and CCT tuning controller is instructed to perform the dimming and CCT tuning adjustment, the dimming and CCT tuning controller executes a dimming and CCT tuning process in a dimming and CCT tuning mode, in which the dimming and CCT tuning controller further performs: (a) controlling the AC current return controller and the modulator to modulate the first three cycles of AC power by turning on and off the power according to a pulse train of a dimming and CCT tuning signals so as to generate the dimming and CCT tuning output power having the dimming and the CCT tuning signal portion embedded therein; (b) delivering the dimming and CCT tuning output power to the multiple lighting devices to demodulate and recover the dimming and the CCT tuning signal portion, to receive AC power, and to perform the dimming and CCT tuning adjustment according to the recovered dimming and CCT tuning signal portion.

The lighting control according to the present disclosure may find applications in general lighting, signage, stage lighting, wall-washer, etc.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Figure 1:
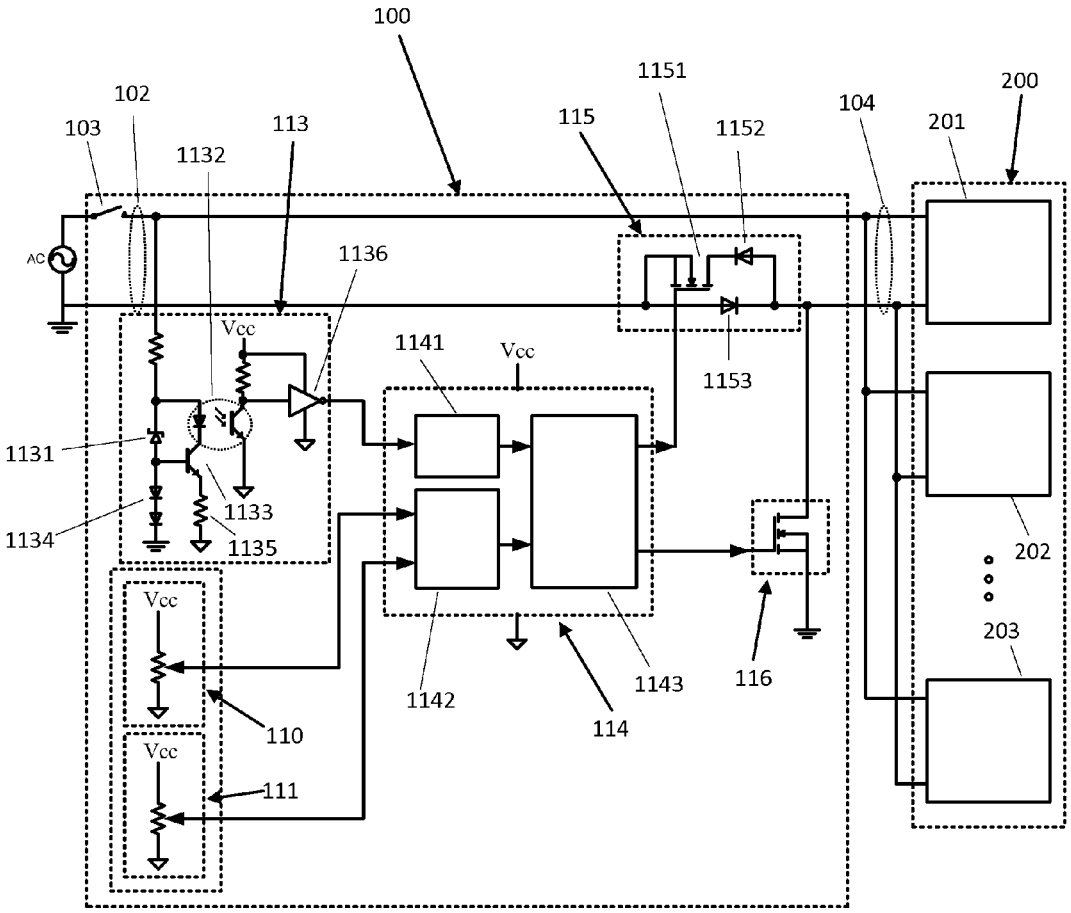
FIG. 1 is a functional block diagram of a dimming and CCT tuning controller connected with multiple lighting devices according to the present disclosure.

FIG. 1 is a functional block diagram of a dimming and CCT tuning controller connected with multiple lighting devices according to the present disclosure. In FIG. 1, a dimming and CCT tuning controller 100 electrically connected to multiple LED-based lighting devices 200 comprises a pair of power input terminals 102 connected to the AC mains via a power switch 103, a dimming input 110, a CCT tuning input 111, a voltage sensing circuit 113 connected to the power input terminals 102 for determining the peaks of AC voltage, a dimming and CCT tuning signal generator 114, an AC current return controller 115, a modulator 116 employed to convert the AC power into a dimming and CCT tuning output power having dimming and CCT tuning signal portion therein, and a pair of dimming and CCT tuning output power output terminals 104 connected to the multiple LED-based lighting devices 200 comprising LED-based lighting devices 201, 202, and 203. The dimming and CCT tuning signal generator 114 comprises a microcontroller, receiving a clock signal from the voltage sensing circuit 113 through a clock module 1141, sensing either a dimming or a CCT tuning signal change from the dimming and CCT tuning inputs 110 and 111 through a sensor module 1142, and sending control signals through a dimming and CCT tuning signal controller 1143. The modulator 116, connected in parallel with the AC current return controller 115, is normally off and is turned on and off at a frequency several times higher than 60 Hz when receiving the dimming and the CCT tuning signals to convert the AC power into the dimming and CCT tuning output power having the dimming and the CCT tuning signal portion therein. The modulator 116 can be an MOSFET, a bipolar transistor, or an insulated-gate bipolar transistor (IGBT).

Figure 2:
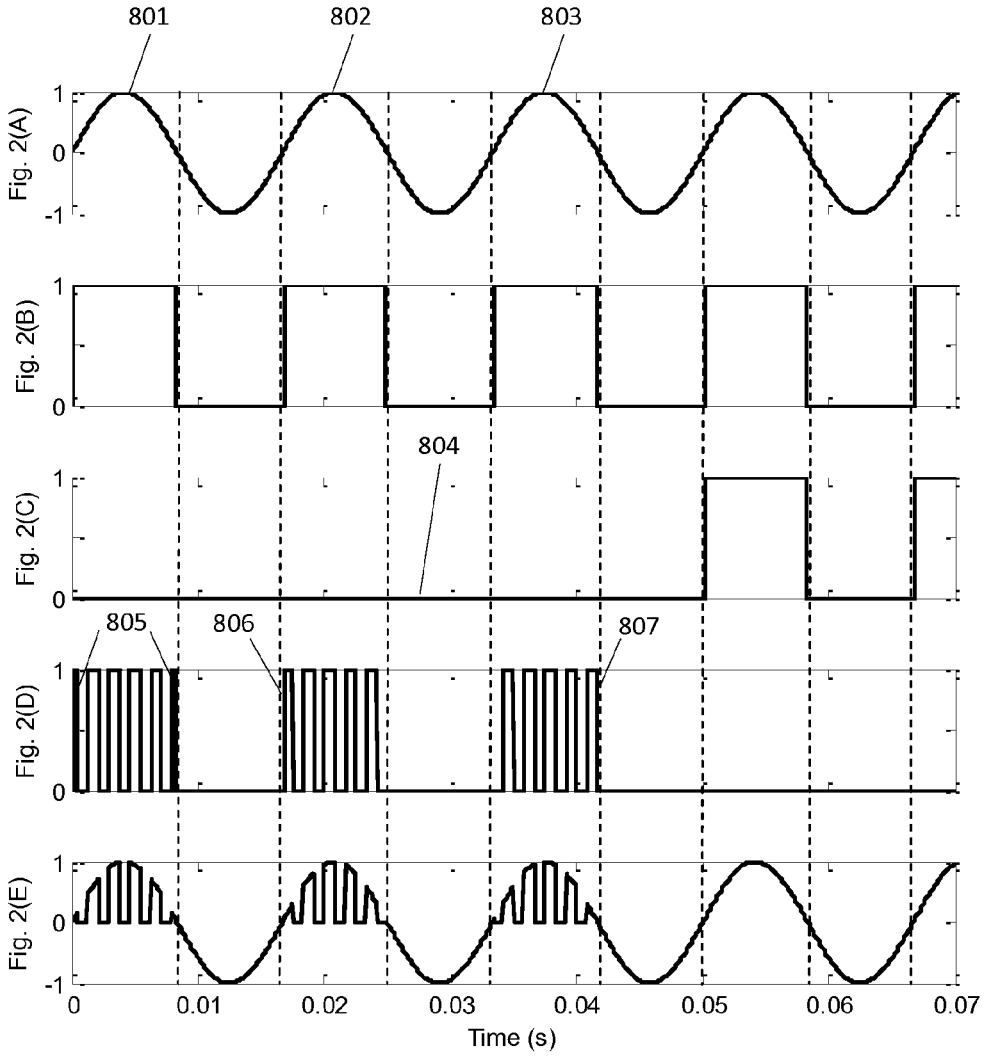
FIG. 2 is a series of control, modulating, and modulated dimming and CCT tuning signal waveforms according to the present disclosure.

FIG. 2 is a series of control, modulating, and modulated dimming and CCT tuning signal waveforms with all the DC waveforms normalized to unity and AC waveforms from minus one to positive one. Referring to FIGS. 1 and 2, the voltage sensing circuit 113 is connected between the AC mains and the dimming and CCT tuning signal generator 114 and has a reference voltage set by a pair of diodes 1134 and a Zener diode 1131 which is connected to the opto-coupler 1132 through a transistor 1133 and a resistor 1135. When the AC voltage exceeds the reference voltage, the base input of the transistor 1133 has a voltage at a high level, turning on the transistor 1133. The inverter 1136 followed then converts a low level at the output of the transistor 1133 into a high level. In other words, when the AC voltage exceeds the reference voltage, the voltage sensing circuit 113 outputs "1" whereas when it drops below the reference voltage, the voltage sensing circuit 113 outputs "0". FIGS. 2(A) and 2 (B) respectively show an AC voltage waveform and an output square wave of the voltage sensing circuit 113, in which the output square wave is always synchronized with the AC voltage. The output square wave is then sent to the dimming and CCT tuning signal generator 114 to provide synchronization information in generating the two control signals.

When users perform either a dimming or a CCT tuning adjustment at either the dimming input 110 or the CCT tuning input 111, the dimming and CCT tuning signal generator 114 senses either a dimming or a CCT tuning signal change and then generates a first set of control signals in first three cycles. The first set of control signals comprises the control signal 1 sent to the AC current return controller 115 and the control signal 2 sent to the modulator 116, both in synchronization with the peaks of the AC mains with clock information provided by the voltage sensing circuit 113. FIG. 2(C) and FIG. 2(D) respectively show the waveforms of the control signal 1 and the control signal 2 in relation to positive and negative half cycles of the voltage of the AC mains shown in FIG. 2(A). As shown in FIGS. 2(C) and 2(D), in the first three cycles, the control signal 1 is always at a low level to disable a current return control switch 1151 blocking electric current flow therein. Instead, in the positive half cycles of the first three cycles of the AC mains, the control signal 2, a pulse train that alternates from "1" to "0", turns the modulator 116 on and off to provide an AC current return path, thus modulating the pulse train in the AC main. For the negative half cycles of the first three cycles, the control signal 2 sent to the modulator 116 is always at a low level to disable the modulator 116 such that the electric current cannot flow through the modulator 116 but through the diode 1153 in the AC current return controller 115, thus generating a normal sinusoidal waveform in the negative half cycles. As a result, the dimming and CCT tuning signal portion is modulated in the AC mains in the positive half cycles of the first three cycles respectively followed by the three negative sinusoidal half cycles, shown in FIG. 2(E). The current return control switch 1151 can be an MOSFET, a bipolar transistor, or an insulated-gate bipolar transistor (IGBT).

After the three cycles, if users do not perform a dimming and CCT tuning adjustment at the dimming and the CCT tuning inputs 110 and 111, the dimming and CCT tuning signal generator 114 senses no dimming and CCT tuning signal changes from the dimming input 110 and the CCT tuning input 111 and then generates a second set of control signals in a way that the control signal 1 is always at a high level in the positive half cycles and at a low level in the negative half cycles, and the control signal 2 is always at a low level, as shown from the fourth cycle in FIGS. 2(C) and 2(D). In this case, the control signal 2 always turns off the modulator 116, and the control signal 1 turns on the current return control switch 1151 in the positive half cycle such that the return current can flow through the diode 1152 and the current return control switch 1151 of the AC current return controller 115. For the negative half cycles, the electric current flows through the diode 1153 of the AC current return controller 115, thus completely delivering a regular AC power to the multiple LED-based lighting devices 200. Because the voltage sensing circuit 113 continues to provide clock information, the control signal 1 and the control signal 2 are always synchronized with the AC mains to ensure that the dimming and the CCT tuning signal portion can be effectively sent to the multiple LED-based lighting devices 200 to be demodulated. In short, in the first three cycles, the dimming and CCT tuning controller 100 and its system are in a dimming and CCT tuning mode, and the first set of control signals are sent to the AC current return controller 115 and the modulator 116, in which the dimming and CCT tuning output power is delivered to the multiple LED-based lighting devices 200 to operate. From the fourth cycle, the dimming and CCT tuning controller 100 and its system are in a normal mode, and the second set of control signals are sent to the current return controller 115 and the modulator 116, in which a regular AC power is delivered to the multiple LED-based lighting devices to operate. As the modulated dimming and CCT tuning output power lasts only three cycles, the AC voltage waveform remains undistorted for most of time thus affecting the power factor to a minimum.

The control signal 2 in the dimming and CCT tuning mode may have a most common line codes such as a return-to-zero (RZ) format that comprises a high level and a low level, a Universal Asynchronous Receiver/Transmitter (UART) format with the high level representing "1" and the low level representing "0", or any other pulse modulation formats as long as "1" and "0" can be distinguished. Comprising a microcontroller, the dimming and CCT tuning signal generator 114 may have built-in specific lighting settings for different times of the day and may use daylight to offset the amount of electric lighting needed to properly light a space, in order to reduce energy consumption. This can be accomplished by using lighting control systems adopting photo-sensors to reduce luminance of lighting devices in response to changing daylight availability. When a specific time arrives, the dimming and CCT tuning signal generator 114 automatically generates a dimming and CCT tuning output power to achieve automatic luminance and CCT tuning adjustments, such as lighting with higher luminance and lower CCT at night or lighting with lower luminance and higher CCT in the daytime. In the present disclosure, the dimming and CCT tuning signal generator 114 generates the dimming and CCT tuning control signals according to the dimming and the CCT tuning inputs 110 and 111. The dimming and the CCT tuning inputs 110 and 111 may be locally or remotely controlled by users. For example, the dimming and the CCT tuning inputs 110 and 111 may be replaced by a receiver to receive an external dimming and a CCT tuning signals from a remote transmitter. In this case, the dimming and the CCT tuning inputs 110 and 111 may be in other forms than the potentiometer/variable resistor as shown in FIG. 1, which include wireless receivers such as an infrared, a radio, an occupancy sensor, and an audio receiver and direct-wired receiver using a protocol of RS232, RS485, DMX512, or USB (universal serial bus). According to a specific type of the dimming and the CCT tuning inputs 110 and 111, users can remotely send dimming and CCT signals to the dimming and the CCT tuning inputs 110 and 111 via a corresponding user interface transmitter.

In the dimming and CCT tuning mode, users may adjust a dimming level and a CCT up or down. For example, an original light level is at 100% maximum luminance, and adjusting a dimming level up means making the light level less than 100% of its maximum luminance. The minimum luminance is 0%. An original light is at a CCT of 2,700K (warm white), and adjusting a CCT up means increasing the CCT of the light to be greater than 2,700K. In general lighting applications, CCT can vary from 2,700K (warm white) to 5,700K (cool white). Users can adjust CCT of a lighting device within this range to change a room atmosphere for their working or living requirements. Furthermore, since the dimming and CCT tuning controller 100 has built-in dimming and CCT tuning commands configured for different schedules, the present disclosure can automatically generate dimming and CCT tuning control signals upon configured schedules without having to receive users' adjustment signals through the dimming and the CCT tuning inputs.

Not like a conventional TRIAC dimming system in which the phase angle information is continuously sent whether or not a dimming change is needed, the present disclosure uses a command scheme in which the dimming and CCT tuning signal is sent but not resent unless there is a change. As mentioned above, in the dimming and CCT tuning mode, a command initiation signal, a dimming signal, and a CCT tuning signal are embedded respectively in three cycles of the AC mains. The initiation cycle used to identify a start of a dimming and CCT tuning command is vital for the dimming and CCT tuning signal portion to be demodulated and recovered in the multiple LED-based lighting devices 200 controlled by the dimming and CCT tuning controller 100. In the first positive half cycle, a typical pulse train at a frequency several times higher than 60 Hz with 0 degree phase shift is sent to the modulator 116 for initiating the dimming and CCT command, providing not only timing information but also phase information of the pulse train for successfully setting up the dimming signal and the CCT tuning signal in the second and the third positive half cycles.

Figure 3:
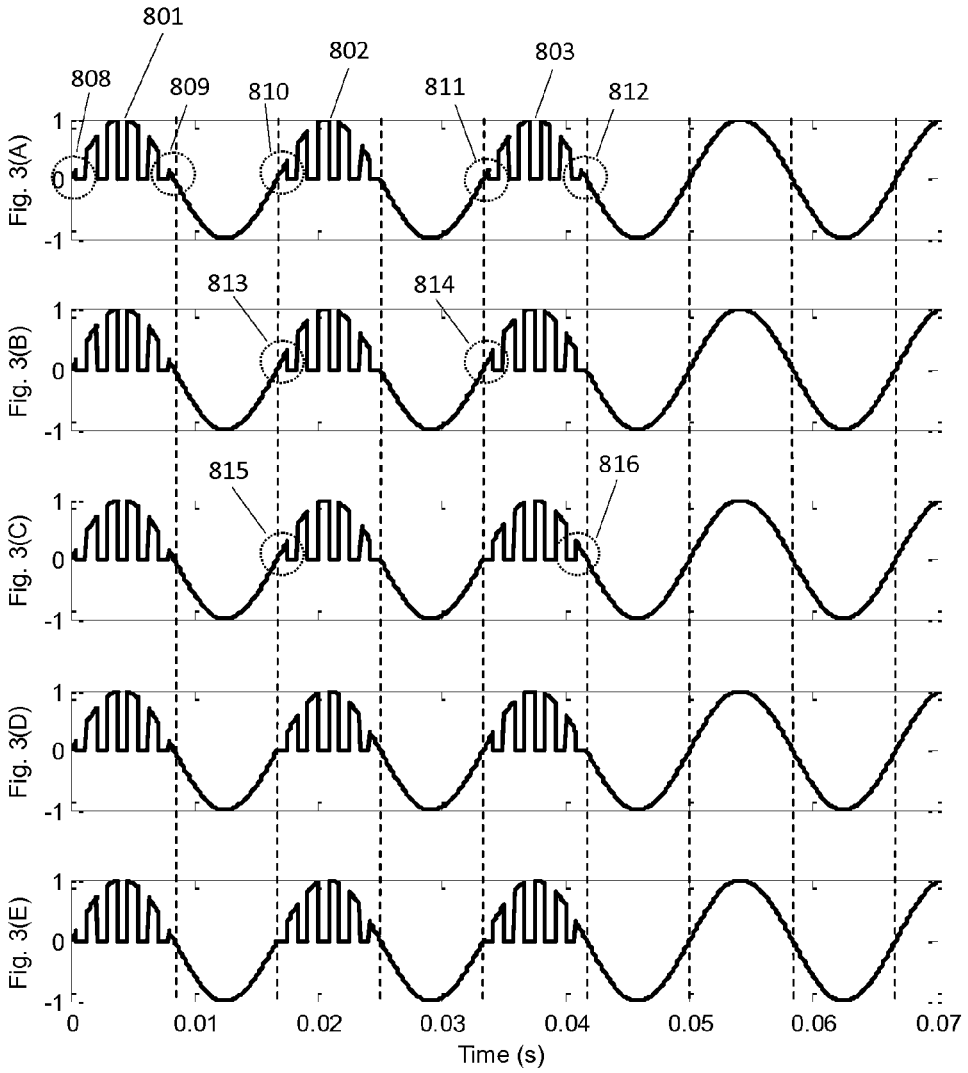
FIG. 3 is a series of modulated dimming and CCT tuning output waveforms according to the present disclosure.

When users adjust a dimming level at the dimming input 110, the dimming and CCT tuning signal generator 114 senses not only a change of dimming level but its sign, plus (up) or minus (down). This can be achieved by a phase modulation of the pulse train. If it is down, say, an increased voltage at the dimming input 110, the dimming and CCT tuning signal generator 114 generates a pulse train with a phase shift 90 degrees backward (phase lag) for the second positive half cycle in the control signal 2 used to turn the modulator 116 on and off; if it is up, the pulse train shifts forward by 90 degrees (phase lead). Similarly for CCT tuning, when users adjust a CCT level at the CCT tuning input 111, the dimming and CCT tuning signal generator 114 senses not only a change of CCT but its sign, plus (up) or minus (down). If it is down, say, an increased voltage at the CCT tuning input 111, the dimming and CCT tuning signal generator 114 generates a pulse train with a phase shift 90 degrees backward (phase lag) for the third positive half cycle in the control signal 2; if it is up, the pulse train shifts forward by 90 degrees (phase lead). If only a dimming level change is sensed by the dimming and CCT tuning signal generator 114, then the pulse train generated in the third positive half cycle in the control signal 2 has no phase shift. FIG. 3 shows some possible dimming and CCT tuning signal portion embedded in the AC voltage waveform. FIG. 3(A) shows a dimming and CCT tuning output waveform with dimming up but CCT unchanged. In the first positive half cycle 801, a waveform of the command initiation shows no spikes at leading edge 808 and trailing edge 809, indicating that there is no phase shift. In the second positive half cycle 802, a spike 810 appearing at the leading edge presents a phase lag of 90 degrees. In the third positive half cycle 803, no spikes at leading edge 811 and trailing edge 812, same as in the first positive half cycle 801; there is no phase shift. FIGS. 3(B)-3(E) respectively show the four cases of dimming down and CCT down, dimming down and CCT up, dimming up and CCT down, and dimming up and CCT up. In FIG. 3(B), a spike 813 at the leading edge in the second positive half cycle shows a phase lag of 90 degrees, an indication of dimming down; a spike 814 at the leading edge in the third positive half cycle shows a phase lag of 90 degrees, an indication of CCT down. Similarly in FIG. 3(C), a spike 815 appears in the leading edge of the second positive half cycle and the other spike 816 in the trailing edge of the third positive half cycle, indicating a case of dimming down and CCT up. FIGS. 3(D) and 3(E) illustrate the remaining two cases, dimming up and CCT down, and dimming up and CCT up.

Figure 4:
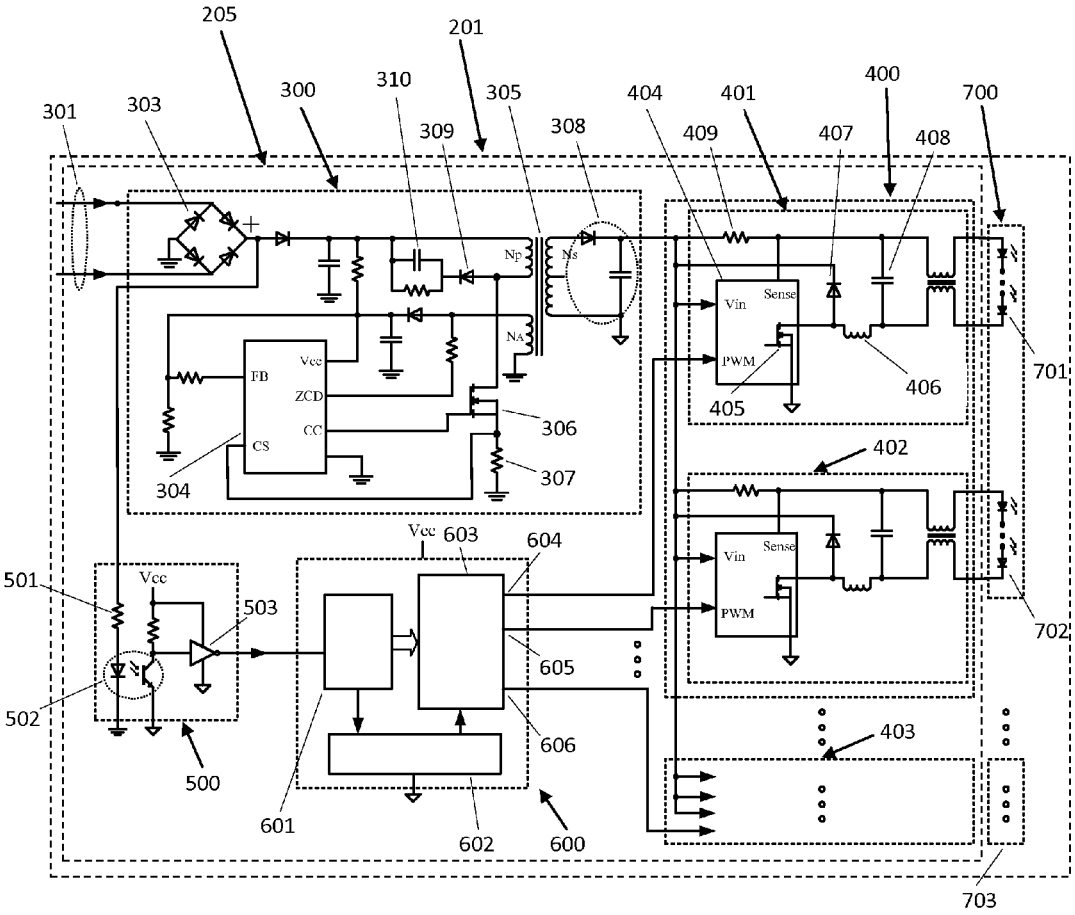
FIG. 4 is a functional block diagram of a dimmable and CCT tunable lighting device according to the present disclosure.

FIG. 4 is a functional block diagram of a dimmable and CCT tunable lighting device according to the present disclosure. In FIG. 4, a lighting device 201 comprises an LED module 700 and a dimming and CCT tuning controllable driver 205 comprising a power supply section 300, an LED driving circuit section 400, a dimming and CCT tuning demodulator 500, and a dimming and CCT tuning control circuit 600. The LED driving circuit section 400 comprises at least two LED driving circuits 401 and 402 respectively connected to at least two types of LED-based light sources 701 and 702 in the LED module 700. LED chips of the at least two types of LED-based light sources 701 and 702 emit different white light at different CCTs; different wavelengths with different saturated colors such as red, green, and blue; or combinations such as one white light at a specific CCT and the other one with a saturated colors of red, green, or blue. In one embodiment, a first type of the at least two types of LED-based light sources may be a white LED having a CCT at 6,200±300 K whereas a second type may have a saturated color at a peak wavelength from 583 to 586 nm to ensure that a resultant light can be in the Planckian locus of the CIE chromaticity diagram. In another embodiment, the first type of the at least two types of LED-based light sources is a white LED having a CCT at 5,700±300 K whereas the second type is a white LED having a CCT at 2,700±300 K. The at least two types of LED-based light sources may comprise a red, a green, and a blue LED light sources. In color mixing applications, LED chips of the at least two types of LED-based light sources 701 and 702 should be mounted in a way that they interlace or encircle each other on an LED printed circuit board (not shown) to ensure color uniformity in the resultant light.

In FIG. 4, the power and signal input terminals 301 in the power supply section 300, connected to the power and signal output terminals 104 of the dimming and CCT tuning controller 100 (in FIG. 1), receives the AC power or the dimming and CCT tuning output power to generate a DC power supplying the at least two LED driving circuits 401 and 402 which further provide two sets of driving current respectively powering the two types of LED-based light sources 701 and 702. The power supply section 300 is a primary-side controlled switching regulator comprising a bridge rectifier 303, a power factor correction and power flyback controller 304, a transformer 305, a current supplying switch 306, a current sense resistor 307, and a DC converter 308. The transformer 305 comprises a primary, a secondary, and an auxiliary winding with their respective turns of windings NP, NS, and NA. The primary winding is connected with the current supplying switch 306, a diode 309, and a capacitor 310 as a buck converter featuring high efficiency. The current sense resistor 307 is connected to the current supplying switch 306 and used to convert the primary-side switch current into a voltage for generating a current control (CC) voltage to feedback-control the switch current. The DC converter 308 is connected in a secondary side of the transformer 305. When an output voltage at the DC converter 308 drops because of LED loads, a reflected voltage generated at an auxiliary winding NA of the transformer 305 feedbacks to FB port to further compare with CS pin voltage to generate a PWM duty cycle triggered by ZCD (zero current detection) signal. A built-in analog multiplier (not shown) in the power factor correction and power flyback controller 304 limits the peak current of the current supplying switch 306 with respect to the AC half wave rectified input voltage. Through controlling the CS comparator threshold as the AC line voltage transverses sinusoidally from zero to peak of line voltage, the load appears to be resistive to the AC line, and thus near to unity power factor can be achieved with good linearity over a wide dynamic range to represent an AC line free from distortion.

In FIG. 4, the LED driving circuit 401 is configured as a buck converter with an internal MOSFET switch 405 in an LED driving current controller 404, an inductor 406, a diode 407, and a capacitor 408. A current sense resistor 409 is connected between the output of the DC converter 308 and the LED-based light source 701 to sense the LED current for the LED driving current controller 404 to regulate the current flowing into the LED-based light source 701. In the LED driving current controller 404, a PWM port is connected to a PWM output terminal 604 of the dimming and CCT tuning control circuit 600 to receive a PWM control signal with a specific duty cycle to further control LED-based light source 701 to emit light brighter or dimmer according to the duty cycle of the PWM signal. The LED driving circuits 402 and 403 have same functions except that their PWM signals have specific duty cycles to control LED-based light sources 702 and 703.

The dimming and CCT tuning demodulator 500 taps a signal from a high potential output of the bridge rectifier 303 of which two inputs are directly connected to the power and signal input terminals 301. If the dimming and CCT tuning signal portion exists in the dimming and CCT tuning output power, then the dimming and CCT tuning demodulator 500 demodulates and converts such signal portion into original pulse trains. In FIG. 4, the dimming and CCT tuning signal demodulator 500 comprises a current limiting resistor 501, an opto-coupler 502, and an inverter 503. The bridge rectifier 303 serves not only to provide a rectified DC voltage for the power supply section 300 but also to ensure the signal entering the opto-coupler 502 can be used with a correct polarity regardless whether the power and signal input terminals 301 are connected to the power and signal output terminals 104 of the dimming and CCT tuning controller 100 (in FIG. 1) with a correct polarity or not.

An input terminal of the dimming and CCT tuning control circuit 600 is connected to the dimming and CCT tuning demodulator 500, and output terminals are connected to the LED driving circuit section 400. The dimming and CCT tuning control circuit 600 comprises an analog-to-digital converter (ADC) 601 to convert analog data into digital ones, a flash memory 602 to store the dimming and CCT tuning signal portion demodulated by the dimming and CCT tuning demodulator 500 and digitized by ADC 601, a processor 603 to generate pulse-width modulated (PWM) control signals according to the dimming and CCT tuning signal portion and to send at least two control signals respectively to the at least two LED driving circuits 401 and 402 so that the LED driving circuit section 400 can drive the at least two types of LED-based light sources 701 and 702 to emit light with a desired luminance and a CCT. Furthermore, the flash memory 602 in the dimming and CCT tuning control circuit 600 may also store a lighting status of the at least two types of LED-based light sources 701 and 702 and even an address of the lighting device 201. Once receiving dimming and CCT tuning signal portion demodulated by the dimming and CCT tuning demodulator 500, the dimming and CCT tuning control circuit 600 increases or decreases the duty cycle of the PWM signals coupled to the PWM inputs of the at least two LED driving circuits 401 and 402 such that the two sets of driving current provided to the two types of LED-based light sources 701 and 702 can change accordingly. Based on magnitude of the currents and their ratio, a resultant light emitting from the two types of LED-based light sources 701 and 702 can emit light with a desired luminance or a CCT. Whereas the address may be stored in the flash memory 602, the command initiation signal in the dimming and CCT tuning signal cluster may contain such address information to call a specific lighting device to respond with a desired luminance or a CCT.

Figure 5:
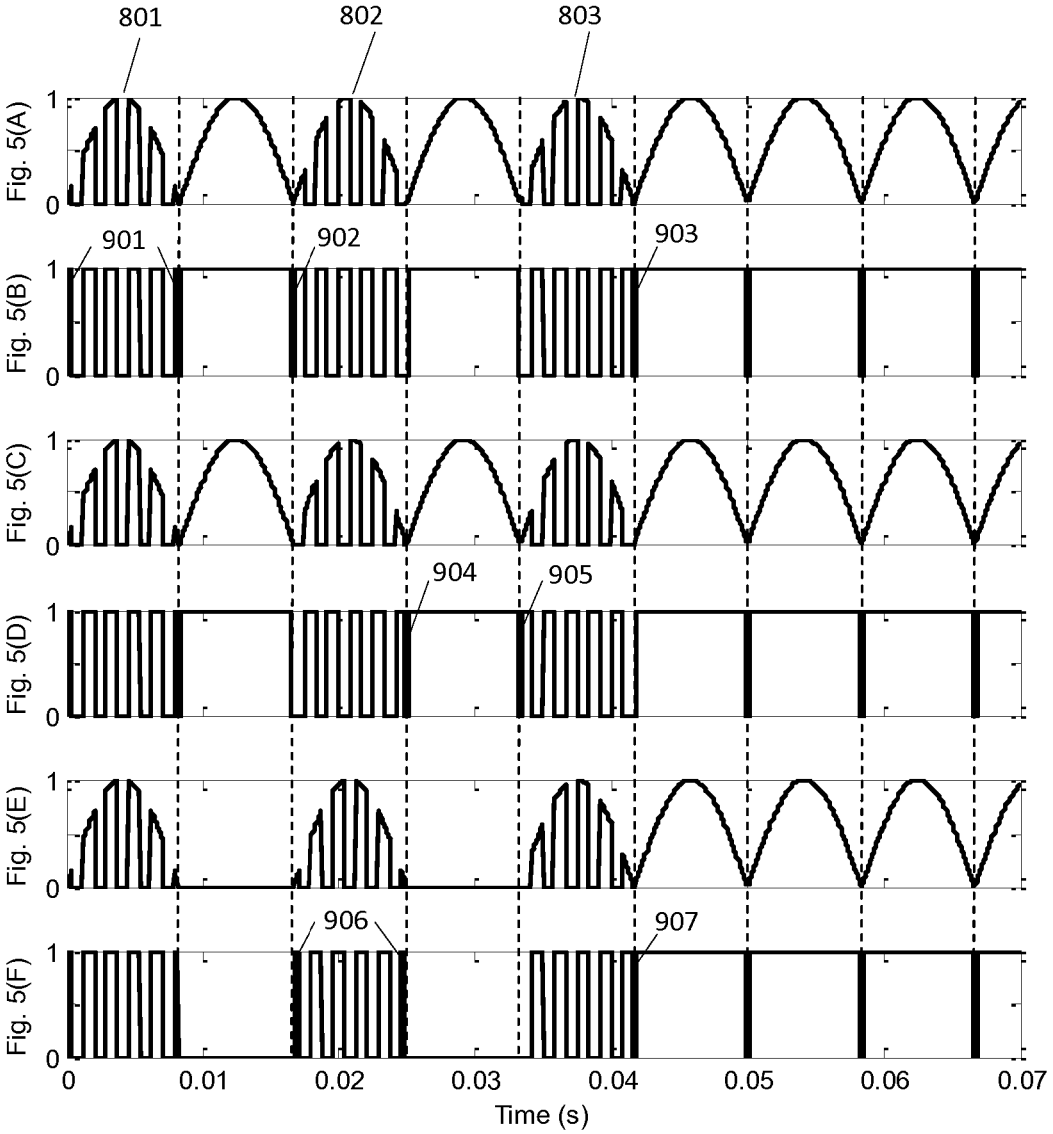
FIG. 5 is a series of demodulated dimming and CCT tuning signal waveforms according to the present disclosure.

In the dimming and CCT tuning mode, there are eight possible dimming and CCT tuning commands which can be embedded in the AC voltage waveform as the dimming and CCT tuning output power is sent from the dimming and CCT tuning controller 100 to the multiple LED-based lighting devices 200. FIG. 5 shows three sets of examples of output waveforms extracted from the bridge rectifier 303 and the dimming and CCT tuning demodulator 500. FIGS. 5(A) and 5(B) show the first set of the example for the case of dimming down and CCT up. Referring to FIGS. 5(A) and 5(B), the first positive half cycle 801 is for dimming and CCT tuning command initiation and phase reference, in which there is no phase shift 901 for the pulse train. The second and the third positive half cycles 802 and 803 in FIGS. 5(A) and 5(B) respectively show signal waveforms before and after the dimming and CCT tuning demodulator 500. The demodulated dimming and CCT tuning signal portion shown in FIG. 5(B) is then sent to the dimming and CCT tuning control circuit 600 which can determine a phase lag 902 in the second positive half cycle 802 and a phase lead 903 in the third positive half cycle 803, a case of dimming down and CCT up. FIGS. 5(C) and 5(D) show the second set of the example representing the case of dimming up and CCT down. Similarly in FIGS. 5(C) and 5(D), the first positive half cycle 801 is for dimming and CCT tuning command initiation and phase reference. The second and the third positive half cycles 802 and 803 in FIGS. 5(C) and 5(D) respectively show the dimming and CCT signal waveforms before and after the dimming and CCT tuning demodulator 500. The demodulated dimming and CCT tuning signal portion shown in FIG. 5(D) is then sent to the dimming and CCT tuning control circuit 600 which can determine a phase lead 904 in the second half positive half cycle 802 and a phase lag 905 in the third positive half cycle 803, a case of dimming up and CCT down. FIGS. 5(E) and 5(F) show the third set of the example for the case of no dimming and CCT up. The demodulated dimming and CCT tuning signal portion shown in FIG. 5(F) is sent to the dimming and CCT tuning control circuit 600 which can determine no phase shift 906 in the second half positive half cycle 802 and a phase lead 907 in the third positive half cycle 803, a case of dimming-no change and CCT up.

In FIG. 4, the multiple LED-based lighting devices 200 can be down lights, par lights, A19 lights, linear tubes and the combination. Each lighting device can have its compatible socket adapter such as E27, E26, MR16, GU10, GU24, G13, etc.

In FIG. 4, the dimmable and CCT tunable lighting device includes an internal dimming and CCT tuning controllable driver 205 and the LED module 700. If dimming and CCT tuning is not required, then the dimming and CCT tuning demodulator 500 and a dimming and CCT tuning control circuit 600 can be removed from the dimming and CCT tuning controllable driver 205. The remaining power supply section 300 and the LED driving section 400 as a whole can be an external LED-based driver that can flexibly control one, two, three or more of non-dimmable LED-based lighting devices in a luminaire. In that case, the power supply section 300 as usual receives the AC power from the AC mains to improve distortion of the current drew by the LED module 700 and to generate a DC power supplying for the LED driving section 400. The LED driving section 400 comprises multiple driving circuits 401, 402, and 403 each connecting to the power supply section to receive the DC power from the power supply section 300 and each respectively driving the LED-based light sources 701, 702, and 703 to emit light. Because each of LED-based light sources 701, 702, and 703 has its individual driving circuit with an independent LED current control, removal of any light sources 701, 702, and 703 from the luminaire will not affect the operation of remaining light sources.

Although for illustration purpose, the control signal sent to the modulator in the dimming and CCT tuning mode is within the first three cycles of AC voltage. The particular number of cycles used is a matter of design choices and depend on how fast the system should respond.

Whereas preferred embodiments of the present disclosure have been shown and described, it will be realized that alterations, modifications, and improvements may be made thereto without departing from the scope of the following claims. Accordingly, the foregoing description and attached drawings are by way of example only, and are not intended to be limiting.

What is claimed is:

1. A dimming and correlated color temperature (CCT) tuning controller, comprising:

power input terminals connected to AC mains;

an AC current return controller;

a dimming input;

a CCT tuning input;

a voltage sensing circuit connected to the power input terminals and configured to determine a voltage peak of the AC mains;

a modulator configured to convert an AC power from the AC mains into a dimming and CCT tuning output power having a dimming and CCT tuning signal portion embedded therein; and a dimming and CCT tuning signal generator configured to receive a signal from the voltage sensing circuit and signals from the dimming input and the CCT tuning input, wherein in response to the dimming and CCT tuning signal generator sensing a change in either a dimming or a CCT tuning signal from either the dimming input or the CCT tuning input, the dimming and CCT tuning signal generator sends a first set of control signals to the AC current return controller and the modulator to control and modulate the dimming and CCT tuning signal portion to form the dimming and CCT tuning output power; and wherein in response to the dimming and CCT tuning signal generator sensing no change in the dimming signal and CCT tuning signal from either the dimming input or the CCT tuning input, the dimming and CCT tuning signal generator sends a second set of control signals to the AC current return controller and the modulator to turn off the modulator.

2. The dimming and CCT tuning controller of claim 1, wherein a control signal sent to the modulator in the first set of control signals comprises a command initiation signal, a dimming signal, and a CCT tuning signal.

3. The dimming and CCT tuning controller of claim 2, wherein the command initiation signal, the dimming signal, and the CCT tuning signal are time-division multiplexed.

4. The dimming and CCT tuning controller of claim 1, wherein both the dimming signal and the CCT tuning signal are in a form of a pulse train.

5. The dimming and CCT tuning controller of claim 4, wherein both the dimming signal and the CCT tuning signal have a format of a universal asynchronous receiver/transmitter (UART).

6. The dimming and CCT tuning controller of claim 4, wherein both the dimming signal and the CCT tuning signal are phase modulation signals.

7. The dimming and CCT tuning controller of claim 1, wherein at least one of the dimming input and the CCT tuning input is a type of potentiometer or a variable resistor.

8. The dimming and CCT tuning controller of claim 1, wherein at least one of the dimming input and the CCT tuning input is a wireless receiver.

9. The dimming and CCT tuning controller of claim 8, wherein the wireless receiver is a radio receiver, an infrared receiver, an occupancy sensor, or an audio receiver.

10. The dimming and CCT tuning controller of claim 1, wherein at least one of the dimming input and the CCT tuning input is a direct-wired receiver.

11. The dimming and CCT tuning controller of claim 10, wherein the direct-wired receiver uses a protocol of RS232, RS485, DMX512, or USB.

12. A dimming and correlated color temperature (CCT) tuning lighting system, comprising:

a dimming and CCT tuning controller, comprising:

power input terminals connected to AC mains;

an AC current return controller;

a dimming input;

a CCT tuning input;

a voltage sensing circuit connected to the power input terminals and configured to determine a voltage peak of the AC mains;

a modulator configured to convert an AC power from the AC mains into a dimming and CCT tuning output power having a dimming and CCT tuning signal portion embedded therein; and a dimming and CCT tuning signal generator configured to receive a signal from the voltage sensing circuit and signals from the dimming input and the CCT tuning input, wherein in response to the dimming and CCT tuning signal generator sensing a change in either a dimming or a CCT tuning signal from either the dimming input or the CCT tuning input, the dimming and CCT tuning signal generator sends a first set of control signals to the AC current return controller and the modulator to control and modulate the dimming and CCT tuning signal portion to form the dimming and CCT tuning output power; and wherein in response to the dimming and CCT tuning signal generator sensing no change in the dimming signal and CCT tuning signal from either the dimming input or the CCT tuning input, the dimming and CCT tuning signal generator sends a second set of control signals to the AC current return controller and the modulator to turn off the modulator; and at least one LED-based lighting device, comprising:

at least two types of LED-based light sources; and a dimming and CCT tuning controllable driver, comprising:

a power supply section configured to receive the AC power or the dimming and CCT tuning output power from the dimming and CCT tuning controller to generate a DC power;

an LED driving section connected to the power supply section and configured to receive the DC power and to drive the at least two type of LED-based light sources to emit light;

a dimming and CCT tuning demodulator configured to receive the dimming and CCT tuning output power and extract the dimming and CCT tuning signal portion in the dimming and CCT tuning output power; and a dimming and CCT tuning control circuit configured to generate pulse-width modulated (PWM) control signals according to the dimming and the CCT tuning signal portion and send the PWM control signals to the LED driving section to drive the at least two types of LED-based light sources to emit light with a desired dimming level and a CCT.

13. The dimming and CCT tuning system of claim 12, wherein each of the at least two types of LED-based light sources is an LED, an organic LED (OLED), or a polymer LED (PLED).

14. The dimming and CCT tuning system of claim 12, wherein the dimming and CCT tuning control circuit comprises a flash memory configured to store lighting status and an address of each of the at least one lighting device.

15. The dimming and CCT tuning system of claim 12, wherein the at least two types of LED-based light sources comprise a first type of a white LED having a CCT at 6,200±300 K and a second type of an LED having a saturated color at a peak wavelength from 583 to 586 nm.

16. The dimming and CCT tuning system of claim 12, wherein the at least two types of LED-based light sources comprise a first type of a white LED having a CCT at 5,700±300 K and a second type of a white LED having a CCT at 2,700±300 K.

17. The dimming and CCT tuning system of claim 12, wherein the at least two types of LED-based light sources comprise a red LED, a green LED, and a blue LED.

18. A method implemented in a dimming and correlated color temperature (CCT) tuning system for delivering a power modulated with a dimming and CCT tuning signal portion to multiple lighting devices, the method comprising:

determining, by a dimming and CCT tuning controller, whether to perform a dimming and CCT tuning adjustment based on a user signal;

in response to the dimming and CCT tuning controller determining that the user signal does not instruct performing the dimming and CCT tuning adjustment, the dimming and CCT tuning controller executes a normal process in a normal mode, in which an AC power is delivered to the multiple lighting devices to maintain luminance and CCTs thereof;

in response to the dimming and CCT tuning controller determining that the user signal instructs performing the dimming and CCT tuning adjustment, the dimming and CCT tuning controller executes a dimming and CCT tuning process in a dimming and CCT tuning mode, in which the dimming and CCT tuning controller further performs operations comprising:

controlling an AC current return controller and a modulator to modulate first three cycles of the AC power by turning on and off the AC power according to a pulse train in the dimming and CCT tuning signal portion generated so as to generate a dimming and CCT tuning output power having the dimming and the CCT tuning signal portion embedded therein; and delivering the dimming and CCT tuning output power to the multiple lighting devices to demodulate the dimming and the CCT tuning signal portion, to receive required power, and to perform the dimming and CCT tuning adjustment according to the demodulated dimming and CCT tuning signal portion.

* * * * *